US005735310A

United States Patent [19]

Hipshire

[11] Patent Number: 5,735,310

[45] Date of Patent: Apr. 7, 1998

[54] ADAPTABLE FENCING SYSTEM

[76] Inventor: James Ruble Hipshire, 1724 Thompson Creek Rd., Morristown, Tenn. 37813

[21] Appl. No.: 523,684

[22] Filed: Sep. 5, 1995

[51] Int. Cl.[6] ..... E04H 17/22

[52] U.S. Cl. ..... 256/66; 256/70; 256/65; 256/19

[58] Field of Search ..... 256/19, 59, 66, 256/65, 70, 67

[56] References Cited

U.S. PATENT DOCUMENTS

| | | | |
|---|---|---|---|
| 136,679 | 3/1873 | Temple | 256/59 |
| D. 255,882 | 7/1980 | Kim | D10/121 |
| 673,484 | 5/1901 | Soles | 256/65 X |
| 2,237,669 | 4/1941 | Higman | 256/19 X |
| 3,491,985 | 1/1970 | Grimsley | 256/47 |
| 3,498,588 | 3/1970 | Turner, Jr. | 256/47 |
| 4,027,856 | 6/1977 | Kingsley et al. | 256/47 |
| 4,324,388 | 4/1982 | Klaser | 256/66 X |
| 4,477,058 | 10/1984 | Lowery | 256/67 X |
| 5,104,074 | 4/1992 | Malloy | 248/156 |
| 5,275,382 | 1/1994 | Charbaut et al. | 256/48 |
| 5,297,890 | 3/1994 | Commins | 403/398 |

FOREIGN PATENT DOCUMENTS

| | | | |
|---|---|---|---|
| 143907 | 6/1985 | European Pat. Off. | 256/19 |

*Primary Examiner*—Anthony Knight

[57] ABSTRACT

According to the preferred embodiment of the present invention an improved fencing system is provided comprising standard steel "T" posts, a "T" post driver and pre drilled wooden or plastic planks, pegs that attached the planks to the posts, and modularized plastic posts. The plastic posts is preferred embodiment as an internal cavity throughout the actual length of the posts that accepts and is supported by a standard steel "T" post. The fence posts also contains connections means for accepting and securing various styles of railings including split rail or planks. In addition for use with gate or corner posts an anchor hole cavity is also included parallel to but separate from the "T" posts cavity and is used to accept and secure an anchor member.

20 Claims, 5 Drawing Sheets

ADAPTABLE FENCING SYSTEM

BACKGROUND OF THE INVENTION

1. Field of the Invention

The present invention relates generally to fencing and, more particularly, to an improved modularized post construction for use with a variety of fence styles which provides for improved installation.

2. Description of the Related Art

In the related art, there have been many attempts to improve installation of fencing. For example, in U.S. Pat. No. 5,297,890, issued in the name of Commins, a wood to pipe connection is disclosed which provides for a sturdy and easily attached wood to pipe metal connector which as described can be utilized with metal supports for wooden fencing.

Also known is U.S. Pat. No. 5,104,074 issued in the name of Malloy in which is disclosed a fence support comprised of several "T" oriented support members which also can be used in conjunction with standard fencing in order to provide improved support especially for corner posts.

Again, in U.S. Pat. No. 3,498,588 issued in the name of Turner Jr., a fence post is disclosed comprising metal support with a blade like stabilizing plate mounted at the bottom of the support allowing for increased lateral support for metal type fences in which the posts are shallowly driven.

Additionally, in U.S. Pat. No. 3,491,985 issued, in the name of Grimsley, a post anchor is disclosed providing for similar function to that of the Turner Jr. fence post. Mainly the metal support is provided in which a blade like stabilizing plate is provided or a foot type anchor is provided at the bottom of said post.

Although all of the above cited related art materials describe improvements in fencing and fence posts, none of these references disclose a low maintenance, low labor system of providing better, stronger, more steadily, attractive fencing without the need for labor intensive activities such as digging post holes and without the need for expensive materials such as a split rail, pine or cedar fencing posts, planks or rails.

Consequently, a need has been felt for providing a fencing system that will combine the ease of materials and installation associated with regular steel "T" posts utilized with wiring fencing in combination with more esthetically pleasing aspects of entire wood fencing without the drawbacks associated with wood fencing such as material costs and labor intensity.

SUMMARY OF THE INVENTION

It is therefore an object of the present invention to provide an improved fencing system.

It is another object of the present invention to provide an improved fencing system that is installed with less labor.

It is yet another object of the present invention to provide an improved fencing system that dramatically reduces both labor and maintenance.

It is a feature of the present invention to provide an improved fencing system in which the posts and rail materials are comprised of plastic material and possibly a significant recycled plastic content.

Briefly described according to the preferred embodiment of the present invention an improved fencing system is provided comprising standard steel "T" posts, a "T" post driver and pre drilled wooden or plastic planks, pegs that attach the planks to the posts, and modularized plastic posts. The plastic is posts, in its preferred embodiment, has an internal cavity throughout the actual length of the posts that accepts and is supported by a standard steel "T" post. The fence posts also contains connections means for accepting and securing various styles of railings including split rail or planks. In addition for use with gate or corner posts an anchor hole cavity is also included parallel to but separate from the "T" posts cavity and is used to accept and secure an anchor member.

An advantage of the present invention is that it can be utilized in a number of different styles of fencing.

Another advantage of the present invention is that it provides the esthetic qualities of wooden fencing without the necessity of digging posts holes to secure wooden posts.

Another advantage of the present invention is that it can be manufactured of recycled plastic material.

Yet another advantage of the present invention is that it provides esthetic qualities of wooden fence yet exceeds performance of both wooden and steel fencing and its durability.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

1. Detailed Description of the Figures

Figure 1:
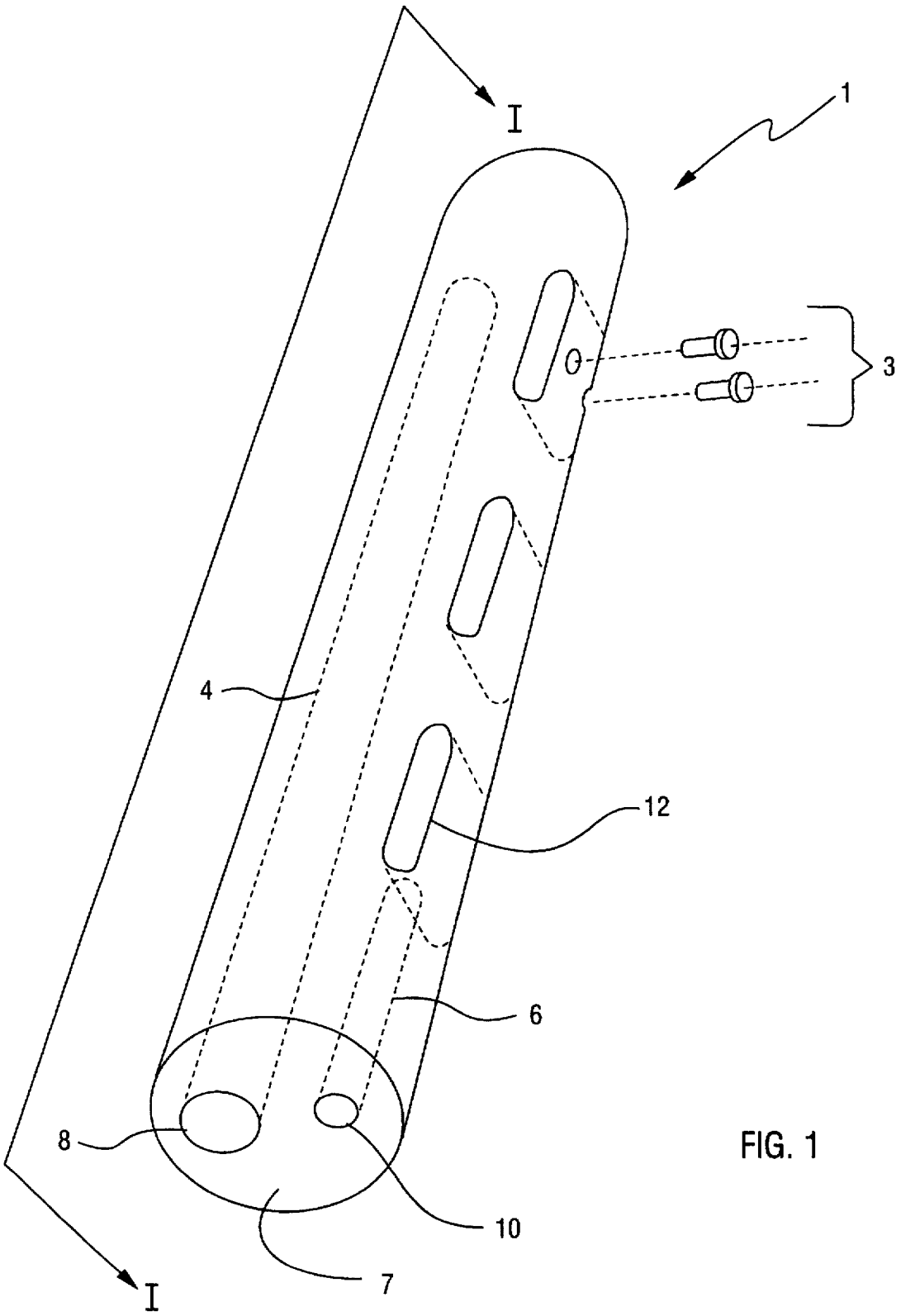
FIG. 1 is a perspective view of a fence post utilized with the preferred embodiment of the present invention.

Referring now to FIG. 1, an adaptable fencing system, generally noted as 1, is shown, according to the present invention, having a modularized plastic post 2 and a plurality of retaining pegs 3. It is currently envisioned that the post and pegs would be made of recycled plastic material. However, as is also envisioned, wood or other traditional fencing materials could also be utilized. Each post 2 has a pair of internal cavities, a first internal cavity 4 running the length of the post 2, and a second internal cavity 6. The first internal cavity 4 extends the length of the post 2 and penetrates a bottom surface 7 with a first receiving hole 8. The second internal cavity 6 extends no greater than one-half of the length of the post 2 and penetrates the bottom surface 7 with a second receiving hole 10. Each post 2 also has a plurality of horizontal plank receiving slots 12 penetrating the post 2 laterally.

Figure 2:
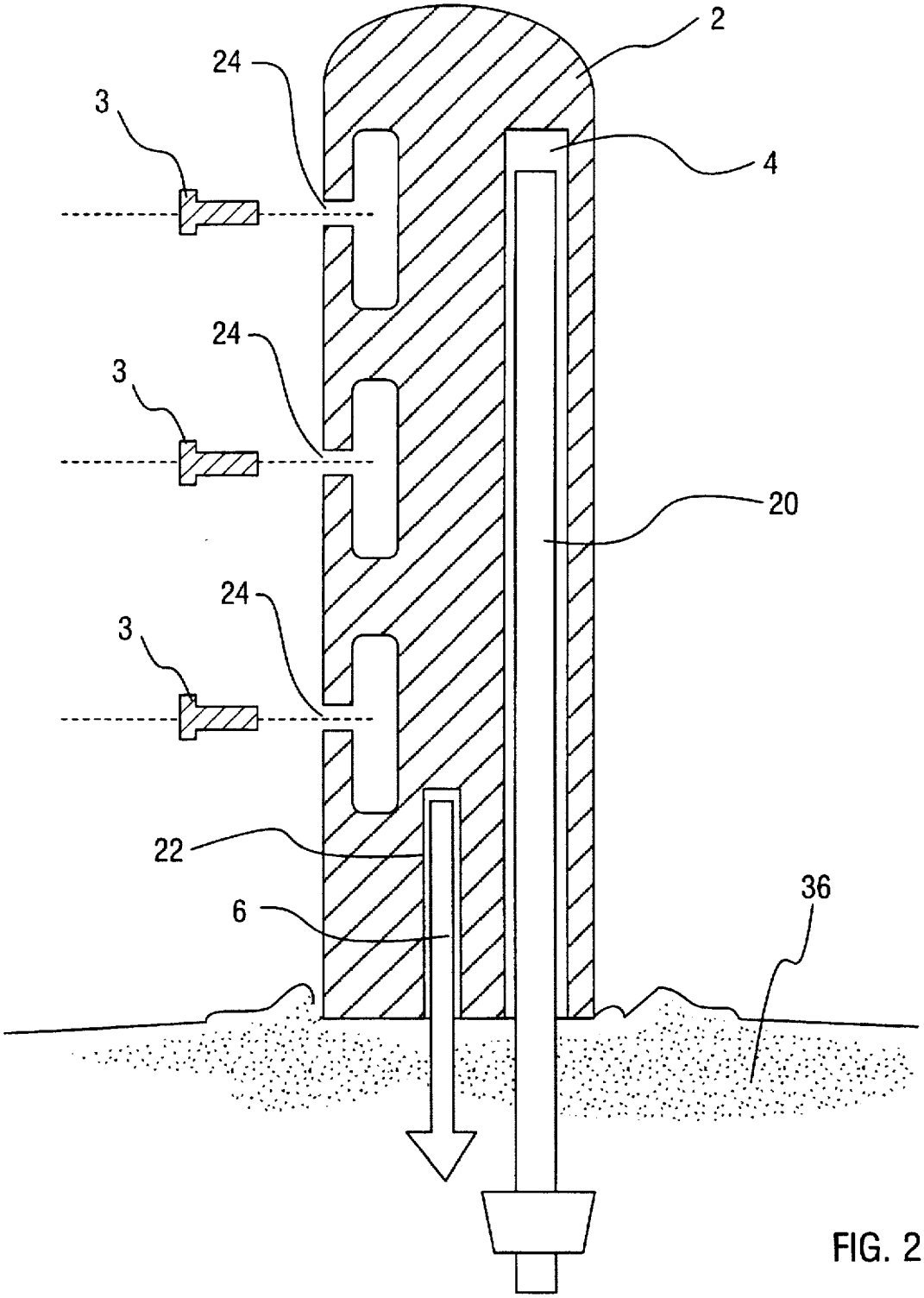
FIG. 2 is a cross sectional side view of the fence post in FIG. 1 taken along lines II.

Referring to FIG. 2, the post 2 can be more clearly shown having the first internal cavity 4 enclosing and containing a standard metal "T"-post 20 of the type commonly utilized for wire fencing or to support traffic signs. The second internal cavity 6 encloses and contains, when necessary, an anchor spike 22. It is currently envisioned that an anchor spike 22 may only be required when utilized with "gate post" applications, as will be described below. However, it is also currently envisioned that an individual user may desire the added stability offered by the use of an achor spike 22 at each or many post locations. The outer surface of the post 2 has peg receiving holes 24 to receive and removably contain the retaining pegs 3. The peg receiving holes 24 allow for the pegs 3 to penetrate into the horizontal plank receiving slots 12.

Figure 3:
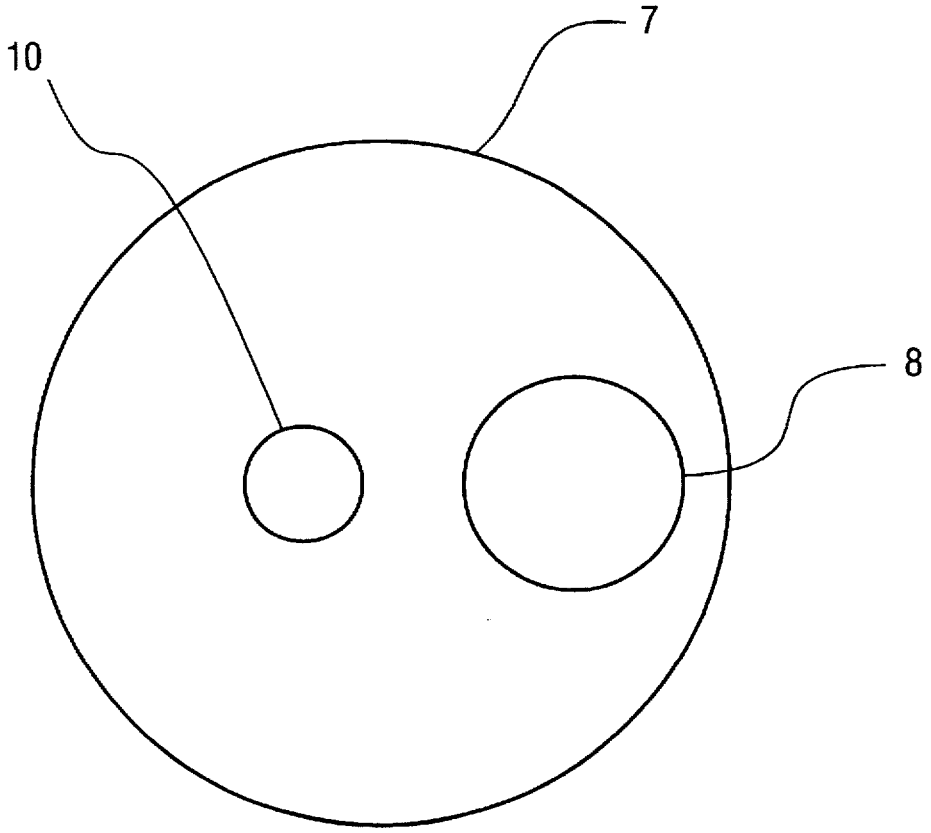
FIG. 3 is a bottom plan view of the fence post described in FIG. 2.

FIG. 3 shows the first receiving hole 8 being located to one outer axial edge of the bottom surface 7, and the second receiving hole 10 being located counter to another outer axial edge of the bottom surface. It is important for the stability of the fencing system that each receiving hole be located away from the midpoint of the post 2.

2. Operation of the Preferred Embodiment

Figure 4:
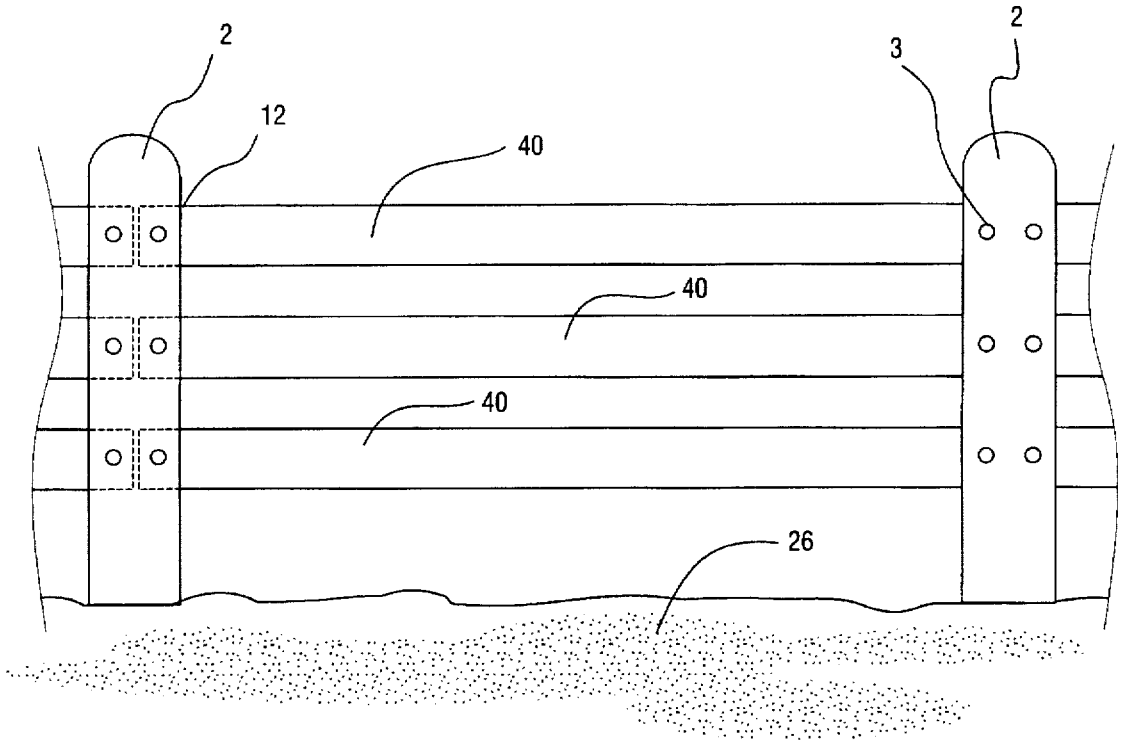
FIG. 4 is a side view of a plank fence utilizing the preferred embodiment of the present invention.

To use the present invention, in accordance with a preferred embodiment of the present invention, as shown in FIG. 2 and FIG. 4, the standard metal "T" post 20 is driven into the ground 26 in a conventional manner as is currently ordinarily utilized. The anchor spike 22 is driven into the ground 26 next to and apart from the T-post 20. Next, a post 2 is placed over the protruding T-post 20 and anchor spike 22 in such a manner that the T-post 20 is contained by the first internal cavity 4 and the anchor spike 22 is contained by the second internal cavity, such that the post 2 sits vertical above the ground 26 such that the bottom surface 7 is in contact with the ground 26. A series of horizontal fencing planks 40 are then inserted into plank receiving slots 12. Finally the retaining pegs 3 are inserted into peg receiving holes 24 such that the pegs 3 impinge upon and thereby secure the edges of the planks 40.

Figure 5:
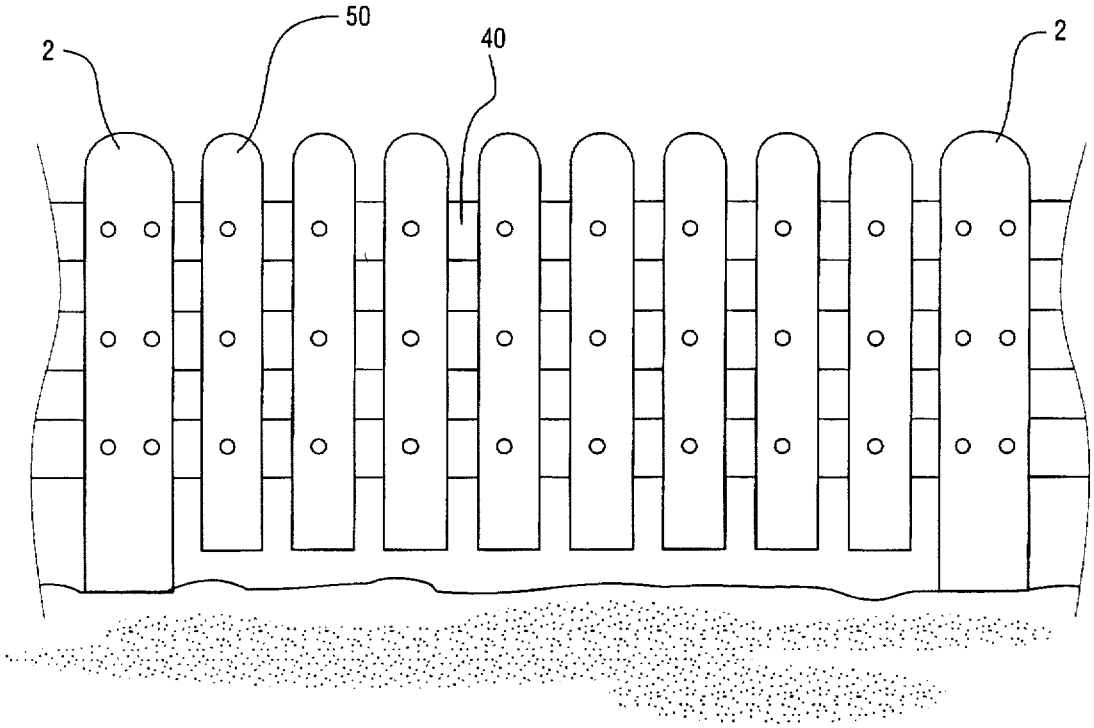
FIG. 5 is a side view of a privacy fence utilizing one typical alternate embodiment of the present invention.

In FIG. 5, one alternate embodiment of the present invention is depicted, wherein a variation occurs in that vertical planks 50 are attached to the horizontal planks 40 by a similar peg impingement method as that which secures the horizontal planks 40 into the posts 2. It is also currently envisioned that many standard attachment method, such as nails or screws, could also be utilized in this configuration. According to this variation, the user could quickly and easily assemble a lightweight, sturdy, and attractive privacy fence without the necessity of digging post holes.

Although preferred embodiments of the invention have been described in conjunction with modular fencing systems, it will be understood that the principles of the invention may be extended to other types of fencing systems rather than merely plank or privacy type fencing., e.g. pole fencing, rail fencing, picket fencing, etc. From the foregoing description, many variations will be apparent to those skilled in the art that would yet be encompassed by the spirit and scope of the invention. The foregoing description of the preferred embodiment of the present invention has been presented for purposes of illustration and description. It is not intended to be exhaustive or to limit the present invention to the precise form disclosed, and obviously many modifications and variations are possible in light of the above teachings.

The preferred embodiment was chosen and described in order to best explain the principles of the present invention and its practical application to those persons skilled in the art, and thereby to enable those persons skilled in the art to best utilize the present invention in various embodiments and with various modifications as are suited to the particular use contemplated. It is intended that the scope of the present invention be broadly defined by the claims which follow.

What is claimed is:

1. A system of fencing requiring no digging of post-holes, said system of fencing utilizing:

modularized outer posts, each said outer post being generally vertically elongated and having an outer surface and a bottom surface;

a first internal elongated cavity, said first internal cavity being contained within and formed by said outer posts, said first internal cavity penetrating said bottom surface and extending substantial the length of said outer post and oriented such that the axial length of said first cavity runs parallel with the axial length of said outer post;

a second internal elongated cavity, said second internal cavity penetrating said bottom surface and extending within said post a distance no greater than one-half the overall length of said post;

a metal inner post of the type generally readily available having an elongated shaft and a base, said base for penetrating the ground, said inner post fitting within said first internal elongated cavity of said outer post for supporting said outer post;

an anchor spike for penetrating firmly into the ground, said anchor spike fitting within and contained by said second internal cavity for securely retaining said outer post;

a plurality of elongated, horizontal plank for connection between adjacent outer posts, thereby forming a fence segment, each said horizontal plank having a pair or connection ends opposite one another; and a plurality of retaining pegs, each said retaining peg for penetrating the outer surface of an outer post for providing connection means for securing said horizontal plank to said outer post.

2. The system of fencing described in claim 1, wherein said outer posts further contain a plurality of horizontal plank receiving slots penetrating said outer surface, each said horizontal plank receiving slot for holdingly receiving the connection end of two horizontal planks.

3. The system of fencing described in claim 1, wherein said first internal elongated cavity and said second internal elongated cavity are oriented parallel to one another, and wherein each said internal elongated cavity is located such that the linear axis is centered radially spaced apart.

4. The fencing system as described in claim 2, wherein said retaining pegs penetrate said outer surface and enter said horizontal plank receiving slots such that said pegs impinge against said horizontal planks, thereby providing said connection means for securing said horizontal plank to said outer post.

5. The system of fencing described in claim 1, further comprising:

a plurality of elongated, vertical planks for connection to the horizontal planks in a horizontally aligned manner such as to create a fence segment providing for substantially reduced visual penetration; and connection means for securing said vertical planks to said horizontal planks.

6. The system of fencing as described in claim 5, wherein said connection means comprises a plurality of plank pegs for retaining and securing said vertical planks by penetration through and impingement with corresponding plank peg receiving holes located along said horizontal planks.

7. The fencing system as described in claim 6, wherein said plank retaining pegs are made of rigid plastic material.

8. The fencing system as described in claim 5, wherein said vertical planks are made of rigid plastic material.

9. The fencing system as described in claim 1, wherein said outer posts are made of rigid plastic material.

10. The fencing system as described in claim 1, wherein said horizontal planks are made of rigid plastic material.

11. The fencing system as described in claim 1, wherein said retaining pegs are made of rigid plastic material.

12. In a fencing system having; metal support post mounted into the ground by forced insertion; anchor spikes for laterally supporting said metal support posts; and horizontal fencing members connecting said support posts and thereby forming a fence segment between two adjacent support posts, the improvement comprising:

an outer post for surrounding and disguising said metal support posts and said anchor spike, said outer post providing aesthetic appearance of a wooden fence post and wherein said outer post comprises modularized outer posts, each said outer post being generally vertically elongated and having an outer surface and a bottom surface;

A first internal elongated cavity, said first internal cavity being contained within and formed by said outer posts, said first internal cavity penetrating said bottom surface and extending substantially the length of said outer post and oriented such that the axial length of said first cavity runs parallel with the axial length of said outer post such as to receive, contain, and disguise said metal support post; and a second internal elongated cavity, said second internal cavity penetrating said bottom surface and extending within said post a distance no greater than one-half the overall length of said post for receiving, containing, and disguising said anchor spikes.

13. In a fencing system as described in claim 12, wherein the improvement comprises further:

horizontal fencing members comprised of a plurality of elongated, horizontal planks for connection between adjacent outer posts, thereby forming a fence segment, each said horizontal plank having a pair of connection ends opposite one another; and a plurality of retaining pegs, each said retaining peg for penetrating the outer surface of an outer post for providing connection means for securing said horizontal plank to said outer post.

14. In a fencing system as described in claim 13, wherein the improvement further comprises a plurality of elongated, vertical planks for connection to the horizontal planks in a horizontally aligned manner such as to create a fence segment providing for substantially reduced visual penetration; and connection means for securing said vertical planks to said horizontal planks.

15. The system of fencing as described in claim 14, wherein said connection means comprises a plurality of plank pegs for retaining and securing said vertical planks by penetration through and impingement with corresponding plank peg receiving holes located along said horizontal planks.

16. The fencing system as described in claim 15, wherein said plank retaining pegs are made of rigid plastic material.

17. The fencing system as described in claim 14, wherein said vertical planks are made of rigid plastic material.

18. The fencing system as described in claim 13, wherein said horizontal planks are made of rigid plastic material.

19. The fencing system as described in claim 13, wherein said retaining pegs are made of rigid plastic material.

20. The fencing system as described in claim 12, wherein said outer posts are made of rigid plastic material.

* * * * *